United States Patent [19]

Frezza

[11] 4,103,402

[45] Aug. 1, 1978

[54] EDGE DRIVE STOP MECHANISM FOR FABRIC SPREADERS

[75] Inventor: Robert Frezza, Carle Place, N.Y.

[73] Assignee: Samcoe Holding Corporation, Woodside, N.Y.

[21] Appl. No.: 793,610

[22] Filed: May 4, 1977

[51] Int. Cl.[2] ..... D06C 5/00

[52] U.S. Cl. ..... 26/74; 26/84

[58] Field of Search ..... 26/74, 84, 85

[56] References Cited

U.S. PATENT DOCUMENTS 3,875,624 4/1975 Frezza ..... 26/84 X

FOREIGN PATENT DOCUMENTS 701,836 1/1954 United Kingdom ..... 26/84

*Primary Examiner*—Robert R. Mackey

*Attorney, Agent, or Firm*—Mandeville and Schweitzer

[57] ABSTRACT

The disclosure is directed to an improved stop mechanism for controlling edge drives of fabric spreaders, in the processing of tubular knitted fabrics. A combination spreader and propeller mechanism, consisting of a frame and fabric engaging belts, is received internally of a section of tubular knitted fabric, in order to distend the fabric laterally during or prior to certain processing operations. The fabric engaging belts are driven by means of edge drive rolls, which externally engage the fabric at its opposite edges and drive the belts through the intervening fabric layer. Occasionally, the fabric may jam on the spreader frame such that, with continued fabric movement, the spreader frame tends to become dislodged from the edge drive rolls. Various photoelectric and mechanical arrangements have been proposed for stopping the equipment at such times, in order to prevent damage to the spreader frame and/or other parts of the equipment. The present disclosure relates specifically to a new and improved magnetic proximity arrangement for stopping the processing equipment in response to dislodgement of the spreader frame from its normal position. The mechanism of the invention incorporates specific features which are ideally suited for the harsh environment in which it operates, frequently involving the processing of wet fabric and/or the application of steam nearby, the presence of lint, etc. The mechanism provides for lateral adjustment of the position of the switch for optimum sensitivity with spreader frames of different configuration.

9 Claims, 5 Drawing Figures

FIG. 3
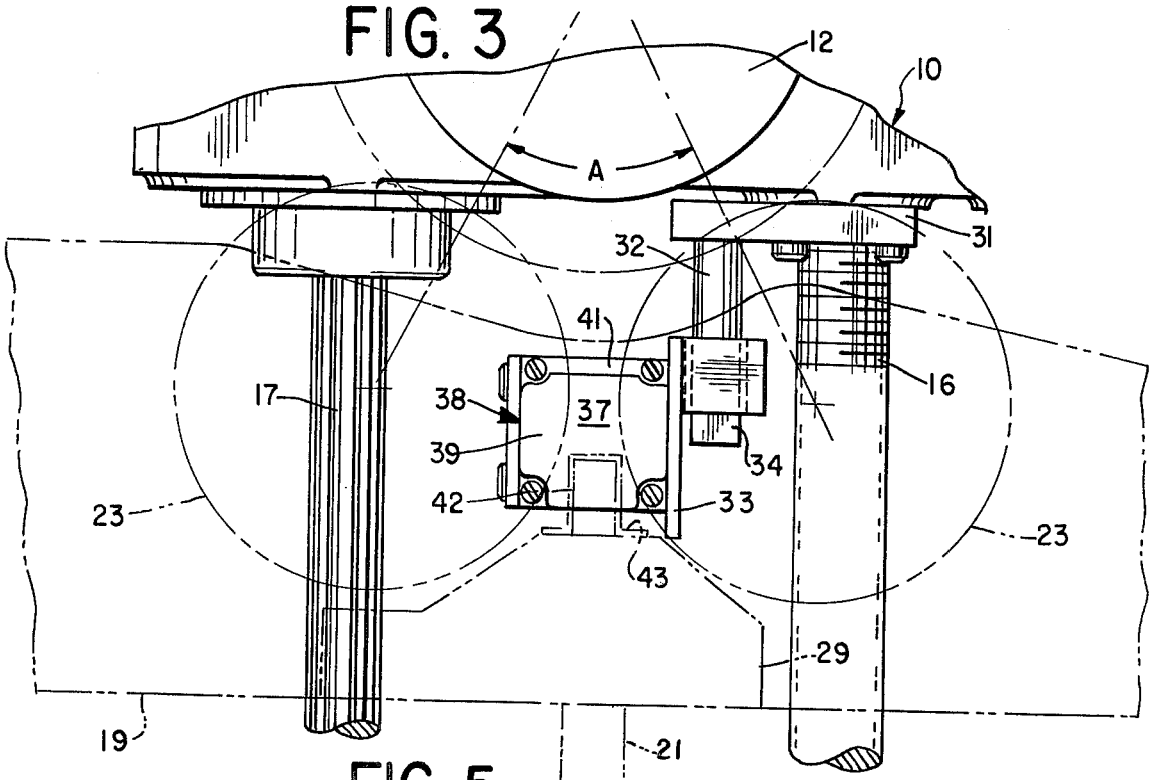
FIG. 5
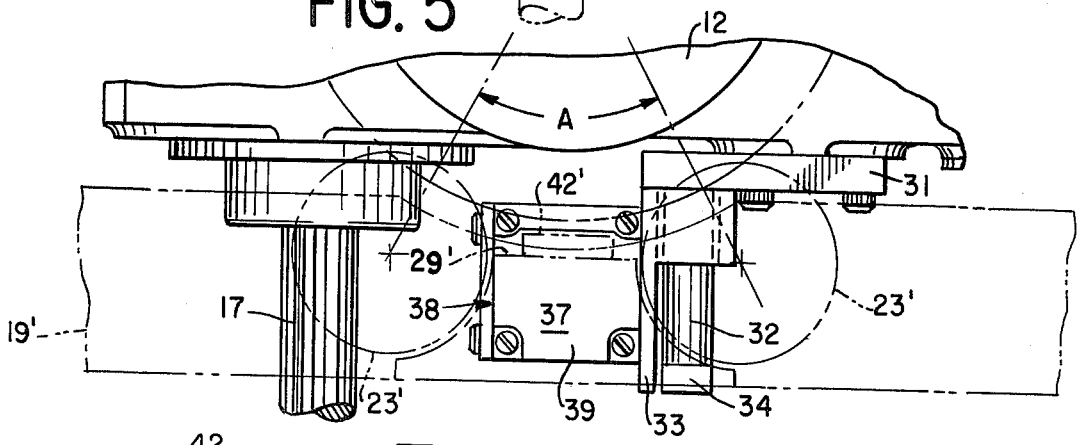
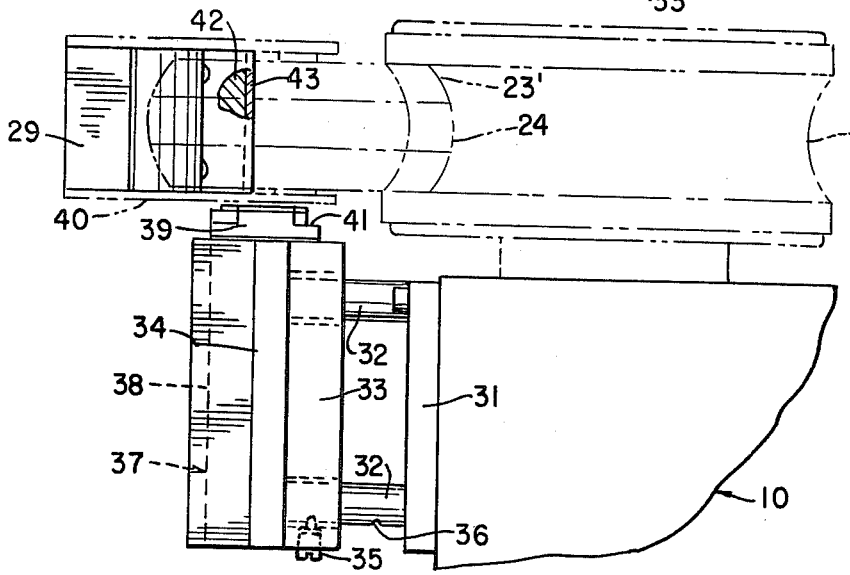
FIG. 4

EDGE DRIVE STOP MECHANISM FOR FABRIC SPREADERS

BACKGROUND AND SUMMARY OF THE INVENTION

In the processing of tubular knitted fabrics, it is frequently necessary or desirable to pass the fabric tube over a spreader frame, which serves to distend the fabric laterally into flat, two-layered form, of predetermined width. Frequently, the fabric is in wet condition and/or is subjected to steam while on the spreader, and the fabric is then discharged from the spreader directly into a subsequent processing machine, such as a calender, compressive shrinkage station, padding or dyeing machine or the like.

Inasmuch as the spreader frame is necessarily received internally of the tubular fabric, and the fabric may be continuous in nature, the spreader frame is required to be supported externally of the fabric tube. In one particularly advantageous form of the fabric spreader frame, the frame is supported by means of power driven edge drive rolls, which engage pairs of idler rolls mounted on the spreader frame itself. Since a layer of fabric is, of course, interposed between the edge drive rolls and the idler support rolls of the frame, relatively light pressure contact is maintained on the spreader frame to avoid marking or damaging the fabric. Moreover, since the entire weight of the spreader frame is supported on the edge drive rolls, the construction of the spreader frame is maintained as lightweight as is reasonably practicable under the service conditions. Accordingly, in a typical commercial installation, the supporting and driving of the spreader frame is a relatively sensitive, delicate structural arrangement. Whenever there is an effective discontinuity in the free flow of tubular fabric onto the upstream or entry end of the spreader frame, such as when the fabric becomes tightly twisted, or the entry end of the spreader penetrates a large tear in the fabric, for example, the forward tension on the fabric may dislodge the spreader frame from its mountings and tend to drag it forward into the processing apparatus. This is, of course, a well known problem, and many mechanical and electrical arrangements have been proposed and provided for the purpose of effecting stoppage of the equipment whenever such dislodgement occurs, to minimize or prevent damage. Advantageous examples of such arrangements are shown in, for example, the earlier Rockman, et al. U.S. Pat. Nos. 3,797,080 and 3,893,213, granted to Samcoe Holding Corp. The mechanisms of the Rockman et al patents provide for limited yieldable mounting of at least one of the edge drive rolls, in conjunction with means for sensing transverse movement of the edge drive roll as results from a dislodgement of the spreader frame.

The system of the present invention has for its ultimate purpose the sensing of any dislodgement of the spreader frame and the stoppage of the equipment as a function thereof. In this sense, the intended function of the system is the same as that of earlier systems. However, the system of the present invention is improved and simplified in significant respect. First, the system provides for mounting of the sensing switch in extremely close proximity to the spreader frame, in the immediate region of its contact with the edge drive rolls, so as to be most highly and most reliably responsive to any tendency of dislodgement of the spreader frame with respect to the edge drive rolls. The system of the invention, provides for mounting of the sensing switch directly underneath the plane of the spreader frame, in order to maintain the area above such plane free of obstruction, while at the same time providing a system which is capable of reliable operation, day in and day out, in the relatively hostile conditions to which it is exposed.

More specifically, the system of the invention includes a magnetically actuated sensing switch, which is mounted on the supporting carriage for the edge drive roll, in a position to have its sensing element located directly under the plane of the roll and immediately adjacent the area in which the edge drive roll contacts the belt driving rolls of the spreader frame. Such a sensing element is provided at each side of the machine, so as to sense a tendency for dislodgement at either side. In conjunction with the magnetic sensing devices as thus described, the spreader frame itself includes, along each of its side rails, a magnetic element, which is mounted in the frame, between the support rolls and at a location as close as reasonably practicable to the adjacent edge drive roll, when the spreader is in its normal operating position. The arrangement is highly sensitive to any tendency toward dislodgement of the spreader frame, and serves to quickly shut down the equipment in response to any such tendency. In this respect, the system of the invention is operative to sense any displacement of the spreader frame independently of the amount or direction of accompanying lateral displacement of the edge drive rolls themselves, and thus is adapted to a significantly higher degree of sensitivity than has been attained heretofore.

In addition to being highly sensitive and responsive to malfunction, the system of the invention, even utilizing sensing devices mounted underneath the processing plane, is ideally suited for reliable, day-in-day-out operation in the rugged environment to which it is exposed. In this respect, the fabric passing over the spreader frame frequently may be wet with water or processing chemicals, to which the sensing elements may be directly exposed. Even where the fabric is processed dry, the presence of lint can be a problem with many control devices. However, inasmuch as the sensing elements are magnetically responsive, they may be easily completely sealed and thus not affected significantly by severe conditions of operation.

The system of the invention not only provides a significantly superior degree of operational effectiveness, but is also highly economical to install and maintain. Overall, it represents a highly advantageous improvement in the art.

For a better understanding of the above and other features and advantages of the invention, reference should be made to the following detailed description and to the accompanying drawings.

DESCRIPTION OF THE DRAWINGS

FIG. 3 is an enlarged, fragmentary view of the edge drive mechanism and magnetic switch mounting, with a portion of the spreader frame mechanism shown in phantom lines.

FIG. 4 is a fragmentary cross sectional view as taken generally on line 4—4 of FIG. 1, with certain parts illustrated in phantom lines, to show the relationship of magnetic switch and magnetic actuating elements.

FIG. 5 is a fragmentary plan view, similar to FIG. 3, illustrating the mechanism of the invention incorporated in conjunction with a modified spreader frame.

DESCRIPTION OF PREFERRED EMBODIMENTS OF THE INVENTION

Figure 1:
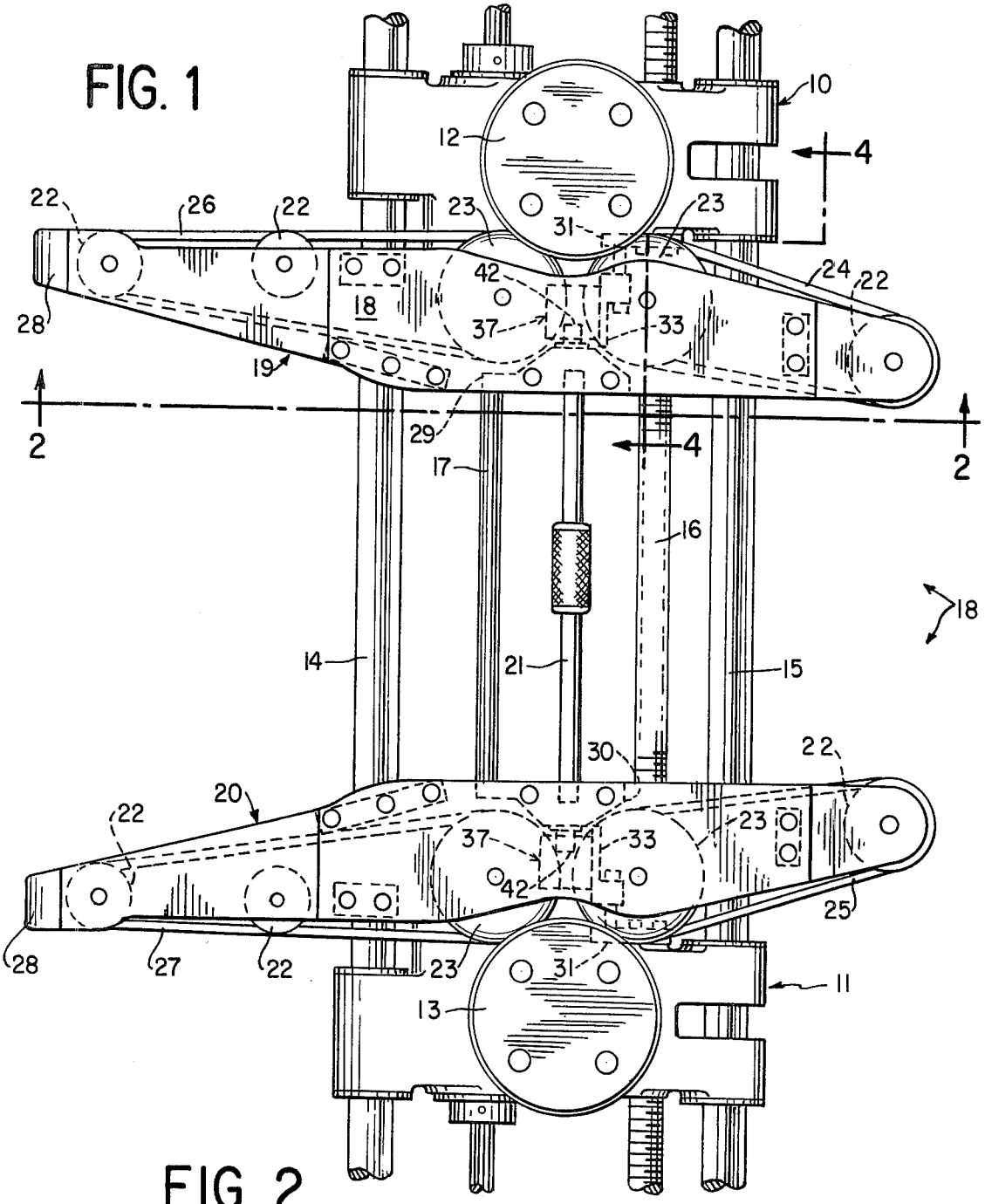
FIG. 1 is a top plan view of a spreader apparatus and edge drive mechanism incorporating a magnetic displacement detector according to the invention.
Figure 2:
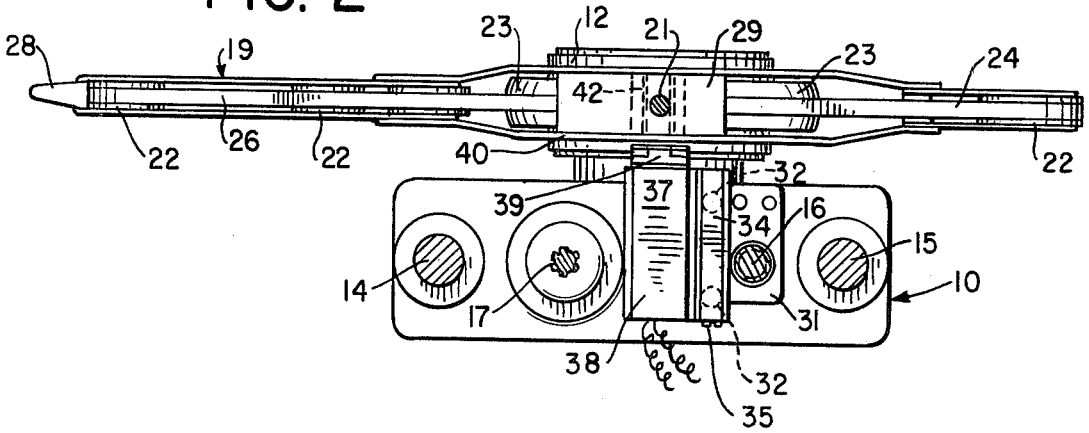
FIG. 2 is a cross sectional view as taken generally on line 2—2 of FIG. 1.

Referring now to the drawing, and initially to FIGS. 1–4 thereof, the reference numerals 10, 11 designate opposite side carriages for mounting edge drive rolls 12, 13. The carriages are slidably mounted on guide rods 14, 15, for transverse movement, and are engaged by a threaded adjusting shaft 16 and also by a drive shaft 17. The drive is splined or otherwise keyed slidably to internal drive mechanisms within the carriages 10, 11, so that the edge drive rolls 12, 13 may be controllably driven by means of the shaft 17 in any lateral position of the carriages. The threaded shaft 16 is oppositely threaded at each end and is thus arranged, when rotated, to simultaneously move the carriages 10, 11 toward or away from the center axis of the machine. As will be appreciated, all of the rods and shafts 14–17 are suitably mounted and/or driven in an appropriate machine frame (not shown) which in itself is well known.

In a conventional propeller-spreader apparatus for processing tubular knitted fabric, there is a spreader frame 18, which consists of a pair of spaced belt frames 19, 20 held in predetermined spaced relation by means of an adjustable spacer rod 21. The respective belt frames 19, 20 comprise upper and lower plates, typically formed of a lightweight material such as aluminum. The belt frames journal a plurality of idler rolls 22 and opposed pairs of belt drive rolls 23 respectively.

In accordance with well known construction of spreader frames for the purpose intended, the belt drive rolls 23 are spaced slightly apart and are formed with a convex cross sectional contour on their outer surfaces. The edge drive rolls 12, 13, on the other hand, are formed with concave cross sectional configuration on their outer surfaces. Accordingly, when the frame and edge drive rolls are properly positioned, the convexly contoured belt drive rolls are received in the concave contours of the edge drive rolls, with the entire weight of the spreader frame being supported by the respective rolls. Likewise, as is apparent in FIG. 1, the fore and aft positioning of the spreader frame is fixed by the slightly straddling relationship of the pairs of belt drive rolls 23 with respect to the edge drive rolls 12, 13.

When tubular knitted fabric is applied over the upstream end (right-hand side in FIG. 1) of the spreader frame, the opposite edges of the fabric are engaged by first stage spreader belts 24, 25 which are being driven by the upstream belt drive rolls 23. The fabric is carried forwardly by the belts, and the wall of the fabric passes between the rolls 23 and their respective edge drive rolls 12, 13. After passing the edge drive rolls, the fabric is engaged and advanced by the downstream belts 26, 27. At the downstream extremity of the spreader, the belt frames 19, 20 typically may have tapered forward ends 28 arranged to be received closely in the roller nip of a further processing apparatus.

Because the entire weight of the spreader frame and any fabric passing over it is supported by reason of the interengagement of convex and concave roller surfaces at the edge drive, the spreader frame as a whole is desirably constructed to be as light as practicable. Thus, the upstream and downstream extending portions may be constructed of relatively thin aluminum strips or plates. The compression load of the edge drive rolls 12, 13 is supported primarily by the adjustable connecting rod 21, which is end secured to the respective belt frames 19, 20 by means of anchor blocks 29, 30.

In the processing of tubular knitted fabric on an apparatus such as illustrated in FIG. 1, the incoming tube of knitted fabric may from time to time become snagged on the spreader frame. For example, the fabric supplied to the spreader may be gathered in a relatively random fashion in a container, and may be twisted as it is drawn out of the supply container. If the twist is not promptly removed by a machine operator, the fabric may not open up properly as it approaches the upstream end of the spreader. As the fabric continues to be drawn in the downstream direction, not only by the action of the edge drive rolls 12, 13, but usually also by the action of a downstream processing apparatus (not shown), the spreader frame will tend to be wrenched out of its supported position in the edge drive rolls. This may also occur if there is a tear or discontinuity in the incoming fabric, large enough to permit one of the belt frames 19 or 20 to project through the side wall of the tube. If this condition is not immediately detected, the continuing advance of the fabric will cause the spreader frame to be wrenched out of its supported position between the edge drive rolls 12, 13.

Various arrangements have been provided in the past for dealing with this occasional tendency of dislodgement of the spreader frame. One such arrangement is illustrated in the prior U.S. Pat. No. 3,875,624 to Robert Frezza, which is owned by Samcoe Holding Corporation. The system of the Frezza patent involves providing for a resilient, yieldable association between the edge drive carriages and the positioning screw shaft. Upon dislodgement of the spreader frame, one or both of the edge drive carriages are displaced, and this motion is utilized to actuate a switch and shut down the equipment. Alternatively or in conjunction with such an arrangement, the spreader frame may be provided with a so-called crash bar arrangement, which serves as a physical barrier to downstream movement of the spreader frame. The crash bar is designed to prevent drawing of the spreader frame into the downstream processing apparatus in cases where the equipment is not shut off in a timely manner.

The apparatus of the invention provides an automatic detecting control, for stopping the equipment in response to physical dislodgement of the spreader frame, which is both simpler and more reliable than prior controls and is, at the same time, more sensitive to relative displacement of the spreader frame from its intended position. The system of the invention includes a magnetic sensing switch device, which is mounted on the edge drive carriage at each side, in a position to be directly underneath the spreader frame, in the immediate region in which the belt drive rolls of the spreader frame contact the edge drive rolls. The spreader frame itself carries a magnetic sender element, in the form of a permanent magnet, which is positioned to directly overlie the magnetic switch when the spreader frame is in its proper position. Any tendency for the spreader frame to move relative to the edge drive rolls results in relative movement between the magnet and the magnetic sensing device which actuates the sensing device and quickly stops the equipment.

As is reflected particularly in FIGS. 3 and 4, each of the edge drive carriages 10, 11 have secured thereto a mounting plate 31 from which extend a pair of transversely disposed guide rods 32. A mounting bracket 33 is slideably supported on the guide rods 32 for movement between the plate 31 and a stop bar 34 secured at the outer ends of the guide rods. In the illustrated form of the invention, the mounting bracket 33 is arranged to have two primary positions on the guide rods 32, an outer position, illustrated in FIGS. 3 and 4, and an inner position, illustrated in FIG. 5. The bracket may be held in either of those positions by means of a detent or stop screw 35 engageable in notches 36 in the lower guide rod, as reflected in FIG. 4. If desired, of course, provision may be made for multi-location positioning or infinite adjustability of the mounting bracket 33, as may be desired.

Secured to the mounting bracket 33 is a magnetic switch assembly 37, which advantageously may be a commercially available magnetic limit switch, such as R. B. Denison No. SGO 8003. The described switch is completely sealed, and its housing or body 38 is secured to the mounting bracket 33 in generally vertical relation, directly underneath the processing plane for the fabric, as defined by the spreader frame. Desirably, the cap or top 39 for the magnetic limit switch has its upper surface located as close as practicable to the lower plate 40 of a properly positioned spreader frame (see FIGS. 2 and 4) with sufficient clearance being provided, however, to accommodate the passage of a layer of fabric without undesirable rubbing on the surface of the cap 39. In the illustrated arrangement, the cap 39 is specially recessed at 41, in the area immediately adjacent the edge drive rolls 12, 13 such that, when the mounting bracket 33 is in its innermost limit position, the cap 39 can be extremely close in to the adjacent edge drive roll, with a portion of the cap extending underneath the edge drive roll in the area of the recess 41.

As is reflected in FIGS. 3 and 4, the magnetic limit switch 38 is located so as to lie directly under and symmetrically between the belt drive rollers 23 (see FIGS. 3, 5).

Rigidly secured to the upper and lower plates of the individual belt frames 19, 20 are the anchor blocks 29, 30 which serve, among other things, to engage the spacer bar 21. According to the invention, a magnetic sender element 42 (FIG. 3 and 4) is adhesively or otherwise mounted to the outer face of each of the anchor blocks 29, 30, in a position to project outward substantially into the gap between the pairs of belt drive rollers 23. In the embodiment of FIGS. 1–4, the magnet 42 may be held in place by means of a metal bracket 43, which is secured to the anchor block 29. The arrangement is such, as shown particularly in FIG. 3, that, when the spreader frame is properly positioned between and supported by the edge drive rolls 12, 13, the magnetic element 42 will be located directly above and generally centered with the upper end of the magnetic limit switch 37. As long as the magnet 42 remains thusly positioned and in immediate vertical proximity to the cap 39 of the limit switch (see FIG. 4), the switch will remain in a predetermined condition. However, any motion of the magnetic element in the fore and aft direction will immediately actuate the switch to another condition and shut down the apparatus. This will occur whether or not there has been significant lateral displacement of the magnet element 42 in relation to the switch.

In the arrangement illustrated in FIGS. 1–4, the belt drive rollers 23 are of relatively large diameter and are relatively closely spaced at their nearest points. In this respect, it is undesirable to space the centers of the belt drive rollers too far apart so as to cause the belt drive rollers to engage the edge rollers at tangent points which are spaced excessively wide. Typically, for example, with edge drive rolls having an effective diameter of about 6 inches, it is appropriate that the respective points of tangency of a pair of belt drive rollers with a common edge drive roller be separated by an arc A of somewhere around 60°. As is reflected by comparison of FIGS. 3 and 5, where the belt drive rollers are relatively large in diameter, they will relatively closely approach each other at the narrowest point. On the other hand, where the belt drive rollers are relatively small in diameter, as reflected by the rollers 23′ in FIG. 5, the belt drive rollers are rather widely separated at the narrowest point between them, even though the angle A separating the points of tangency remains approximately the same.

Thus, pursuant to one aspect of the invention, the mounting of the magnetic switch 37 is adjustable transversely on the guide rods 32 so as to accommodate the location of magnets 42, 42′ in slightly different positions in frames of different size. In the spreader frame of FIG. 3, for example, the anchor block 29 extends into close proximity to the relatively large diameter belt drive rollers 23, and the magnetic element 42 projects even further in between the rollers 23. Nevertheless, because of the practical physical limitations of the spreader frame, the magnetic element 42 is spaced somewhat outward from the edge drive roller 12. In the embodiment of FIG. 5, on the other hand, using substantially smaller diameter belt drive rolls 23′, the individual belt frames 19′ may be substantially narrower in width, and the anchor block 29′ extends substantially closer in to the surface of the edge drive roll 12. In the case of the latter embodiment, the magnetic element 42′ advantageously is relatively flat, so as not to interfere with the edge drive roll, whereas the magnetic element 42 of the FIG. 3 apparatus is relatively elongated in the transverse direction, so as to extend closer in toward the edge drive roll. The desirability in either case is to locate the magnetic sending element 42, 42′ relatively closely adjacent to the edge drive roll 12.

To accommodate the fact that the magnetic element 42 will be required to be spaced different distances from the edge drive roll, with spreader frames of different frame widths and roll diameters, the switch mounting is movable inward or outward, in the manner reflected in FIGS. 3 and 5. By, in general, providing for the magnetic switch and sensing elements to be as close as practicable to the edge drive roll, depending upon the specific geometry of the spreader frame itself, the control maintains an optimum sensitivity to detect any tendency of displacement from the desired position.

The apparatus of the invention is uniquely advantageous for the specific purposes intended. The ability to utilize a totally sealed, magnetic sensing switch enables the switch to be mounted directly underneath the spreader frame, in extremely close proximity thereto, while at the same time maintaining the entire area above the plane of the edge drive rolls clear of obstructions. The sealed sensing element is unaffected by the rather hostile environment which may involve the processing of tubular knitted fabric which is wet with water and/or chemicals. Even where dry fabric is being processed, the area may be exposed to steam and/or lint, which can cause erratic behavior in electrical apparatus.

In the system of the invention, each spreader frame is provided with its own optimally positioned, fixed magnetic elements, which are incorporated into the spreader frame structure, completely concealed and protected. All that is required in the setting up of the processing apparatus with a new spreader frame is to readjust the transverse positioning of the detecting switch, if necessary, so as to be located for most effective cooperation with the built-in magnetic element of the spreader frame.

By locating the magnetic sending elements between pairs of belt drive rollers of the spreader frame, and as close as practicable to the edge drive rolls, it is assured that a high degree of sensitivity to undesired spreader frame motion is afforded. At the same time, the system is relatively insensitive to spurious signals, such as might result from vibration of unsupported parts of the spreader frame.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. In an apparatus for processing tubular knitted fabric and including a spreader frame and opposed edge drive rolls engaging and supporting said spreader frame, an improved system for detecting displacement of said spreader frame with respect to said edge drive rolls, which comprises (a) magnetic sensing switches mounted closely adjacent to and in predetermined relation to said edge drive rolls, (b) said sensing switches being mounted below the plane of said spreader frame, (c) magnetic elements mounted in fixed relation to said spreader frame at each side thereof and normally positioned in close proximity to said magnetic sensing switches, (d) said magnetic sensing switches being operative to stop said processing apparatus upon displacement of a magnetic element in relation to its associated sensing switch.

2. An apparatus according to claim 1, further characterized by (a) said spreader frame including a pair of laterally spaced, longitudinally extending belt frames, (b) each of said belt frames having a pair of belt driving rolls mounted in closely spaced relation and adapted for frame-supporting contact with said edge drive rolls, (c) said magnetic elements being mounted one in each belt frame generally between said belt driving rolls.

3. An apparatus according to claim 2, further characterized by (a) means mounting said magnetic sensing switches for lateral adjustment with respect to said edge drive rolls.

4. An apparatus according to claim 2, further characterized by (a) said belt frames including upper and lower frame plates, (b) said magnetic elements and said belt driving rolls being mounted between said frame plates.

5. An apparatus according to claim 4, further characterized by (a) said magnetic sensing switches being mounted directly below and in close proximity to the lower frame plate of each belt frame.

6. An apparatus according to claim 4, further characterized by (a) a spacer bar extending transversely between and connecting the respective belt frames, (b) anchor blocks mounted in each of said belt frames and engaging said spacer bar at its opposite ends, (c) portions of said anchor blocks projecting between the belt driving rolls of each pair, and (d) said magnetic elements being mounted on the projecting portions of said anchor blocks.

7. In an apparatus for processing tubular knitted fabric and including a spreader frame and opposed edge drive rolls engaging and supporting said spreader frame, and where the spreader frame includes spaced, longitudinally extending belt frames each mounting a pair of belt drive rolls engaging an edge drive roll in straddling relation, an improved system for detecting displacement of said spreader frame with respect to said edge drive rolls, which comprises (a) a permanent magnet member mounted on each of said belt frames generally between the belt drive rolls thereof, (b) a sealed, magnetic sensing switch associated with each of said edge drive rolls and positioned for cooperation with said magnetic elements when said belt drive rolls are properly positioned with respect to said edge drive rolls, and (c) means for adjustably positioning said switches in relation to said edge drive rolls immediately below a plane defined by said spreader frame.

8. An apparatus according to claim 7, further characterized by (a) said edge drive rolls being mounted on and extending upward from laterally movable carriages, and (b) said switches being adjustably mounted on said carriages directly underneath said belt frames.

9. An apparatus according to claim 7, further characterized by (a) said switches including portions projecting above the lower surface extremities of the edge drive rolls, and (b) said switch portions being partially recessed in the regions of said lower surface extremities.

* * * * *